US011666814B1

(12) United States Patent
Bianco

(10) Patent No.: US 11,666,814 B1
(45) Date of Patent: Jun. 6, 2023

(54) HITTING TRAINING TOOL FOR BASEBALL OR SOFTBALL

(71) Applicant: Matthew J. Bianco, Upper St. Clair, PA (US)

(72) Inventor: Matthew J. Bianco, Upper St. Clair, PA (US)

(73) Assignee: Matthew J. Bianco, Upper St. Clair, PA (US)

( * ) Notice: Subject to any disclaimer, the term of this patent is extended or adjusted under 35 U.S.C. 154(b) by 0 days.

(21) Appl. No.: 17/097,394

(22) Filed: Nov. 13, 2020

Related U.S. Application Data

(60) Provisional application No. 62/935,390, filed on Nov. 14, 2019.

(51) Int. Cl.
*A63B 69/00* (2006.01)
*A63B 60/54* (2015.01)
*A63B 102/18* (2015.01)

(52) U.S. Cl.
CPC ..... *A63B 69/0002* (2013.01); *A63B 60/54* (2015.10); *A63B 2069/0008* (2013.01); *A63B 2102/182* (2015.10); *A63B 2209/10* (2013.01)

(58) Field of Classification Search
CPC ... A63B 69/0002; A63B 60/54; A63B 2209/10; A63B 2102/18; A63B 2102/182; A63B 2069/0008
USPC .. 473/453, 457, 564; 150/154; 220/737, 739, 220/741
See application file for complete search history.

(56) References Cited

U.S. PATENT DOCUMENTS 2,397,059 A * 3/1946 Swank ..... A61J 9/0684 248/105
3,115,342 A 12/1963 Webster
3,268,226 A * 8/1966 Martino ..... A63B 60/00 473/457
3,618,945 A * 11/1971 Kuchar et al. ..... A63B 59/50 473/457
3,623,724 A * 11/1971 Lande ..... A63B 59/50 473/437
3,833,217 A * 9/1974 Greaney ..... A63B 69/0002 473/457
3,944,225 A * 3/1976 Greaney ..... A63B 69/0002 473/457

(Continued)

OTHER PUBLICATIONS

"Dynamic Stiffness," Bat-Ball Science, Washington State Univ., 2015 (ssl.wsu.edu/glossary/ball-dynamic-stiffness/).

(Continued)

*Primary Examiner* — Sebastiano Passaniti
(74) *Attorney, Agent, or Firm* — K&L Gates LLP

(57) ABSTRACT

A sleeve fits over the barrel of a bat. The sleeve defines an opening such that, when the sleeve is applied to the bat, a significant portion of the barrel of the bat is revealed. The sleeve is made of a light-weight, sound-dampening material, such that when the batter hits a pitched ball in an area of the bat covered by the sleeve, the normal "crack" or "ping" of the ball hitting the bat is not heard. Instead, the batter hears a duller, less sharp sound, providing immediate feedback to the batter that he/she did not hit the ball in the desired area of the bat.

17 Claims, 4 Drawing Sheets

(56) References Cited

U.S. PATENT DOCUMENTS 4,370,978 A * 2/1983 Palumbo ..... A61F 13/062 602/26
4,881,736 A * 11/1989 Fox ..... A63B 60/08 473/417
4,930,772 A 6/1990 Maloney et al.
5,050,877 A * 9/1991 Wales ..... A63B 69/0002 473/437
5,203,390 A * 4/1993 Eckstein ..... A63B 60/62 150/160
5,211,307 A * 5/1993 Jeffries ..... A61J 9/08 220/739
5,213,324 A * 5/1993 Bowers ..... A63B 69/0002
5,273,278 A * 12/1993 Becker ..... A63B 49/02 473/457
D351,868 S 10/1994 Pendergast
5,613,943 A * 3/1997 Palumbo ..... A61F 5/0109 602/26
5,661,920 A * 9/1997 Evans ..... F41G 1/38 150/154
5,695,419 A * 12/1997 Haringa ..... A63B 60/00 473/564
5,888,154 A * 3/1999 Hartman ..... A63B 21/0088 473/457
D415,398 S 10/1999 Wysopal
D418,181 S 12/1999 Fuk Sun Lau et al.
6,129,695 A * 10/2000 Peters et al. ..... A41D 13/05 602/61
6,176,403 B1* 1/2001 Svare et al. ..... A63B 47/001 224/251
6,494,339 B1* 12/2002 Engelhard et al. . A47G 23/0225 220/475
6,533,685 B1* 3/2003 Otten et al. ..... A63B 59/60 473/437
6,565,462 B1 5/2003 Gregg
6,739,989 B2* 5/2004 Liberatore ..... A63B 59/50 473/457
6,872,156 B2* 3/2005 Ogawa et al. ..... A63B 60/54 473/567
6,923,738 B1 8/2005 Fulp
D549,099 S * 8/2007 Edwards ..... D6/518
7,309,292 B2* 12/2007 Tu Teng ..... A63B 69/3614 473/256
7,377,867 B1* 5/2008 Vacek et al. ..... A63B 59/50 473/566
7,540,813 B2* 6/2009 Liberatore ..... A63B 15/00 473/457
7,686,711 B2* 3/2010 Miller ..... A63B 69/0002 473/437
D640,339 S 6/2011 Goldenthal
8,231,484 B1* 7/2012 Quinn ..... A63B 69/0002 473/437
8,297,469 B1* 10/2012 Alford et al. ..... A61J 1/16 220/737
8,444,500 B2* 5/2013 Erkkinen ..... A63B 69/3638 473/256
8,622,854 B2* 1/2014 Suzuki ..... B65F 1/10 473/453
D755,314 S 5/2016 Williams
9,737,777 B2* 8/2017 April et al. ..... G06F 1/1626
9,795,850 B1 10/2017 Sancier
10,441,861 B1* 10/2019 Mattern et al. ..... A63B 60/46
D877,832 S * 3/2020 Bianco ..... D21/753
2004/0206432 A1* 10/2004 Cirone ..... A63B 60/58 150/154
2007/0219027 A1* 9/2007 Chong ..... A63B 60/54 473/564
2008/0234075 A1* 9/2008 Lancisi ..... A63B 59/50 473/457
2010/0281676 A1* 11/2010 Anderson et al. ..... A63B 59/50 29/516
2011/0275458 A1* 11/2011 Estrada, Jr. et al. ... A63B 21/06 473/437
2013/0056120 A1* 3/2013 Rutherford et al. .... A63B 59/52 150/154
2013/0324332 A1* 12/2013 Rauso ..... A63B 59/52 473/564
2014/0371008 A1* 12/2014 Geotsalitis ..... A63B 69/0002 473/457
2015/0202511 A1* 7/2015 Duenas et al. ..... A63B 59/55 473/457
2015/0238834 A1* 8/2015 Esper ..... A63B 69/0002 473/451
2016/0377139 A1* 12/2016 Vito ..... A63B 71/0054 267/141

OTHER PUBLICATIONS

D. Russell, "The sweetspot of a hollow baseball or softball bat," 148th ASA Meeting, San Diego, CA, 2004 (www.acs.psu.edu/drussell/bats/ASA/Russell-sweetspot.html).

A. Nathan, "Regulating the Performance of Baseball Bats," The Hardball Times Baseball Annual 2014 (baseball.physics.illinois.edu/THTAnnual2015-Bats.pdf).

* cited by examiner

HITTING TRAINING TOOL FOR BASEBALL OR SOFTBALL

PRIORITY CLAIM

The present application claims priority to U.S. Provisional Pat. Application Serial No. 62/935,390, filed Nov. 14, 2019, which is incorporated herein by reference.

CROSS-REFERENCE TO RELATED APPLICATIONS

The present application is related to design patent application Serial No. 29/641,649, filed Mar. 23, 2018, now U.S. Pat. D877,832.

BACKGROUND

In baseball and softball, the hitter generally strives to hit a pitched ball with the barrel of the bat. If a young player can learn to regularly hit a pitched ball with the barrel at an early age, though relatively easy instruction, the young player is more likely to continue playing.

SUMMARY

In one general aspect, the present invention is directed to a sleeve, or sleeve-like cover, that fits over the barrel of a bat, e.g., a baseball or softball bat. The sleeve defines at least two openings. First there is a proximal opening into which the barrel of the bat can be inserted so that the sleeve-like cover can cover the barrel of the bat. Second, there is a "barrel" opening such that, when the sleeve is applied to the bat, a significant portion of the barrel of the bat is revealed or exposed by the barrel opening. The sleeve-like cover is made of a light-weight material that is different from the material of the barrel of the bat (e.g., softer than the barrel of the bat), such that when the batter hits a pitched ball in an area of the bat covered by the sleeve, the normal "crack" or "ping" of the ball hitting the bat is not heard. Instead, the batter and others in the vicinity will hear a duller, less sharp sound. This provides immediate feedback to the batter that he/she did not hit the ball in the desired area of the bat. As such, the batter will learn to hit the pitched balls in the desired hitting area of the bat, i.e., the portion of the barrel exposed by the barrel opening in the sleeve, because such contact will produce the normal "crack" or "ping" of the ball hitting the bat. The sleeve can be made of flexible, elastic, resilient and/or soft materials (softer than the barrel of the bat) so that one sleeve can be used on different sized bats. These and other benefits of the present invention will be apparent from the description below.

FIGURES

Various embodiments of the present invention are described herein by way of example in connection with the following figures.

DESCRIPTION

Figure 1:
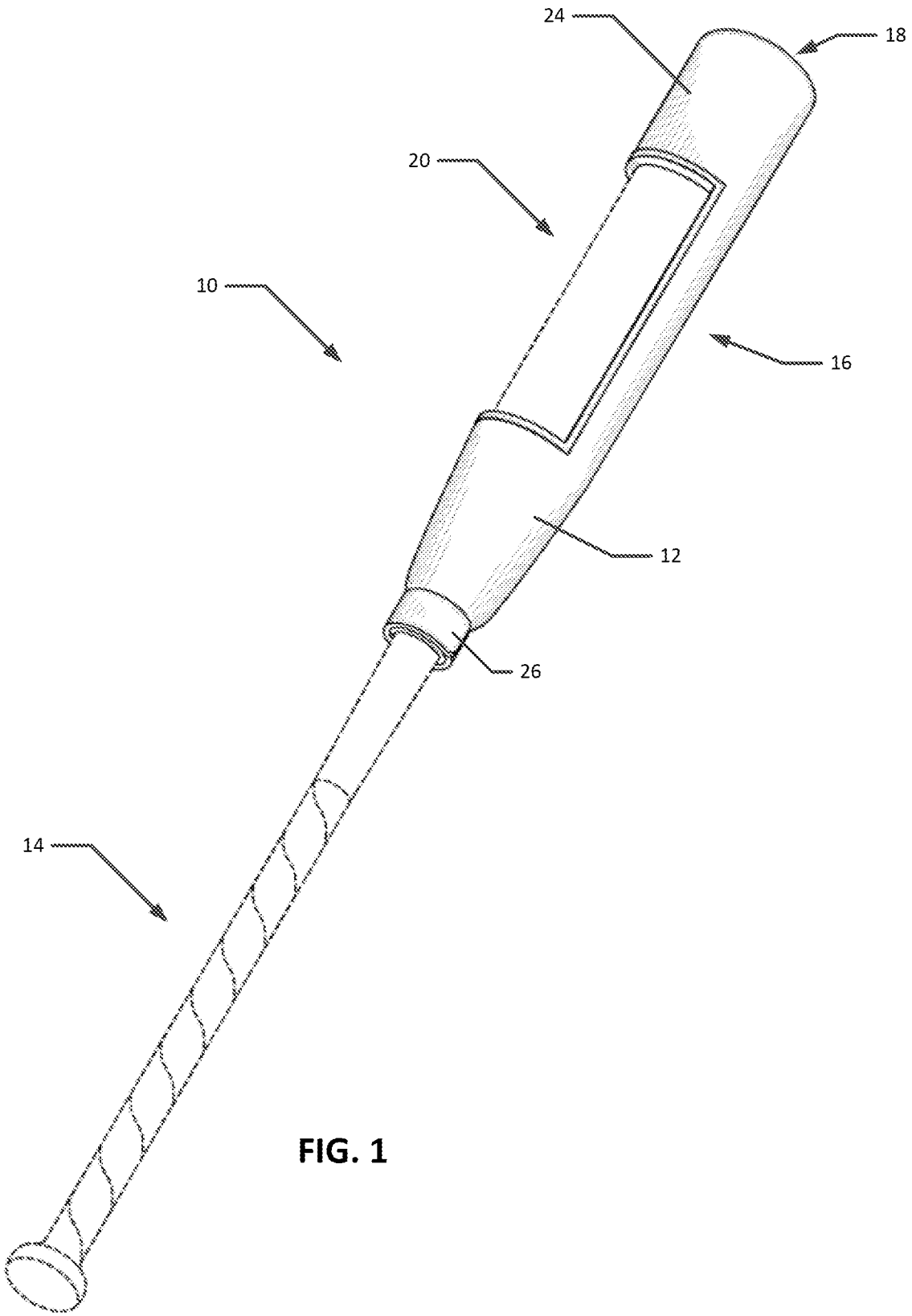
FIG. 1 shows a batting sleeve tool according various embodiments of the present invention applied to a bat.
Figure 2:
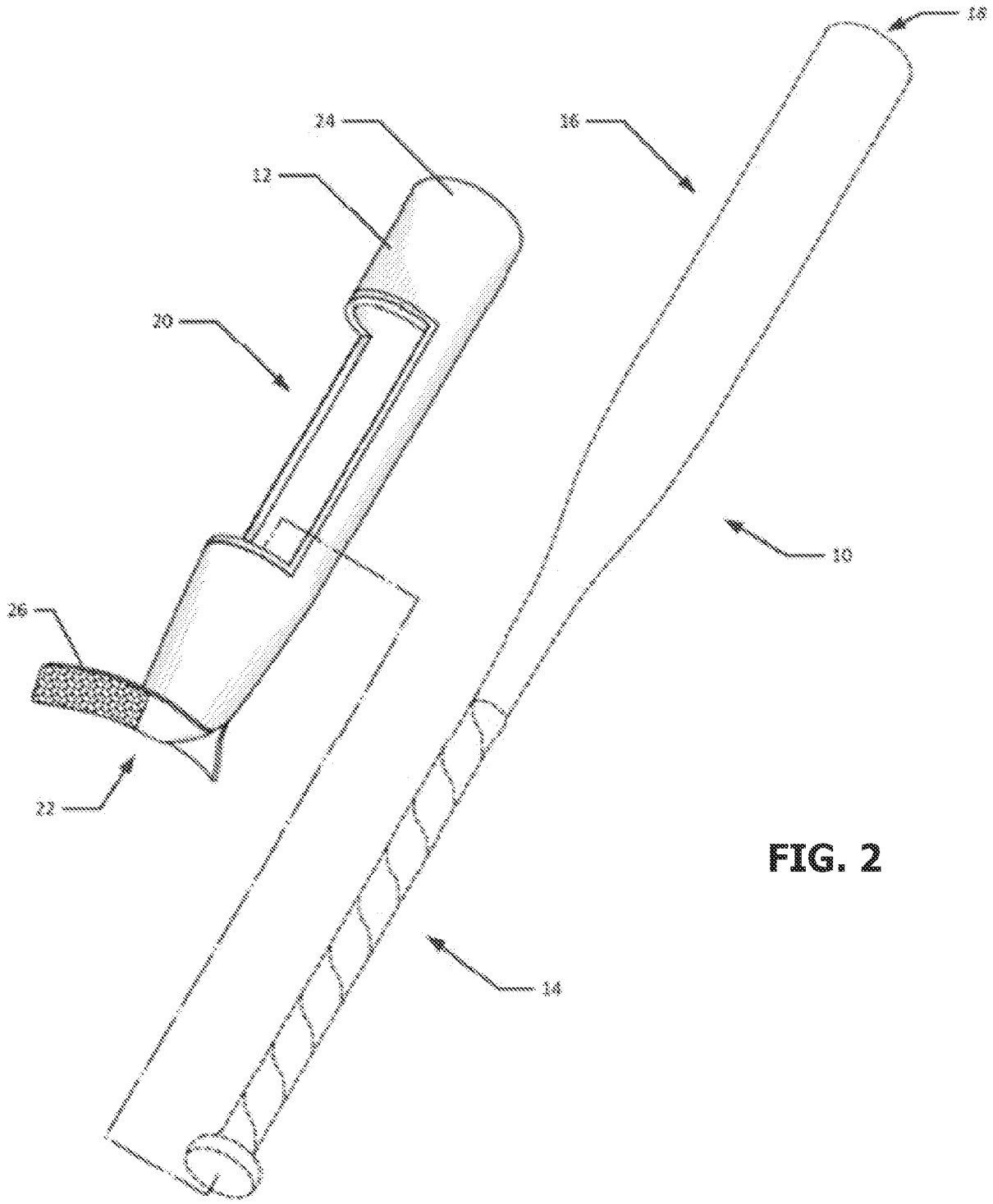
FIG. 2 shows the batting sleeve tool of FIG. 1 and the bat separately.

The present invention is directed to a training tool for hitting, as in baseball or softball hitting. In particular, embodiments of the present invention are directed to a batting sleeve training tool, or sleeve-like cover, 12 as shown in FIGS. 1-7 that fits over the barrel of a bat, e.g., a baseball or softball bat. FIG. 1 shows the bat 10 with the batting sleeve tool 12 applied and FIG. 2 shows the bat 10 and sleeve-like cover 12 separately. The bat 10 comprises a handle 14 at a proximal end, a barrel 16, and an end cap 18 at the distal end of the bat 10. The barrel is the part of the bat where the user intends to strike the pitched ball for maximum effect. The barrel is between the midpoint of the bat and the end cap 18 and is usually the thickest and widest part of the bat 10. The bat 10 can be a baseball or softball bat, and can be made of wood, aluminum, or composite, for example. The bat 10 is swung in the conventional manner; the batter grips the handle 14 with both hands and swings their arms to move the barrel 16 of the bat 10 through the hitting zone to hit a pitched ball.

The tool 12 comprises a sleeve that fits over, at least partially, the barrel 16 of the bat 10. The sleeve 12 could also fit over the end cap 18 as shown in FIGS. 1-2, although that is optional, as in other embodiments the sleeve 12 could have an open distal end such that the end cap 18 is not covered by the sleeve 12 when the sleeve 12 is applied to the bat 10. As shown in FIGS. 1-2, the sleeve 12 covers the barrel 16 of the bat 10 except for a specific portion of the barrel of the bat that is exposed by the "barrel" opening 20 in the sleeve 12. Preferably, the barrel opening 20 is sized to correspond to the sweet-spot of the barrel to train the batter to hit a pitched ball with the portion of the barrel 16 exposed by the opening 20, as opposed to other areas of the bat 10 that are covered by the sleeve 12. The opening 20 may be have squared-off corners and straight edges as shown in FIGS. 1-2, although differently shaped openings could be used in other embodiments, such as oval, for example. As shown in the example figures, the opening 20 exposes, circumferentially, less than 60% of the bat and preferably about 50% circumferentially of the barrel of the bat, at the maximum width of the opening 20 (e.g., an oval opening). Lengthwise, or longitudinally, the opening 20 is less than 50% of the length of the bat 10, and preferably less than 40% of the length of the bat.

The tool 12 is preferably made from a light-weight material that is different from the material of the barrel of the bat, such as cotton, wool, nylon, synthetic rubber (such as neoprene), foam (e.g., polyurethane or polyethylene foam), elastomeric polymer or any other suitable matter. The tool 12 should be light enough so that it does not adversely affect the user's/batter's swing. That is, the tool 12 should be light enough that it does not cause the distal end of the bat 12 to dip when swung by the batter. That is, the tool 12 should be light enough that the batter essentially maintains his/her natural swing even when the tool 12 is applied. For example, the tool 12 can weigh less than 3 ounces and preferably 2 ounces or less. The tool 12 should also change the sound enough so that there is an audible difference between a pitched ball hitting the tool 12 as opposed to the sweat spot of the barrel 16 exposed by the opening 20 in the tool 12. In particular, due to the material of the tool 12, when the batter swings the bat 10 (from the handle 14) and makes contact with the ball in a location of the bat 10 covered by the tool 12 (i.e., not in the opening 20), the natural "crack" or "ping" of the ball hitting the bat 10 should be duller and less sharp than when the ball hits the barrel 16 without the tool 12. Conversely, when the user/batter makes contact with the ball in a location of the bat 10 exposed by the opening 20, the normal "crack" or "ping" of the pitched ball hitting the bat 10 will be heard. In this manner, the user/batter receives immediate audible feedback about whether he/she is contacting the pitched ball in the proper locating with the bat 10. If the normal crack is heard, the batter immediately knows that he/she made proper contact with the pitched ball. Conversely, if the sound is lessened due to the ball hitting the tool 12, the batter will immediately know that he/she did not make proper contact.

The tool 12 is preferably flexible and elastic enough so that it can fit over the barrel of different-sized bats and so that the opening 20 can be positioned in a desired location relative to the barrel 16 of the bat 10, and so that the tool 12 will stay in place when in use. The sleeve-like cover is also preferably flexible/resilient so that it can revert back to its original shape and configuration (or near its original shape/configuration) after being hit by a pitched ball. In various embodiments, there could be differently sized baseball bat sleeves 12 (e.g., small, medium, large, etc.) that each fits over the barrel for a select range of baseball bat sizes and there could be differently sized softball bat sleeves 12 that each fits over the barrel for a select range of softball bat sizes.

Figure 3:
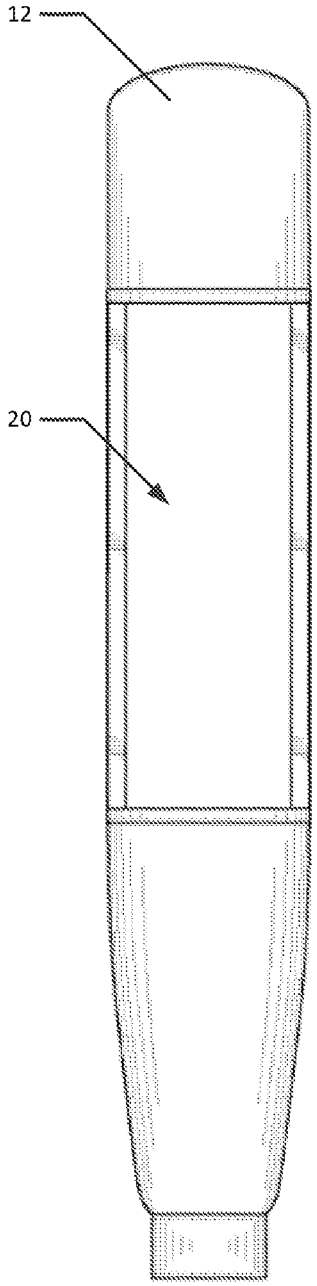
FIGS. 3-5 show front, rear and side views, respectively, of the batting sleeve tool of FIG. 1.
Figure 4:
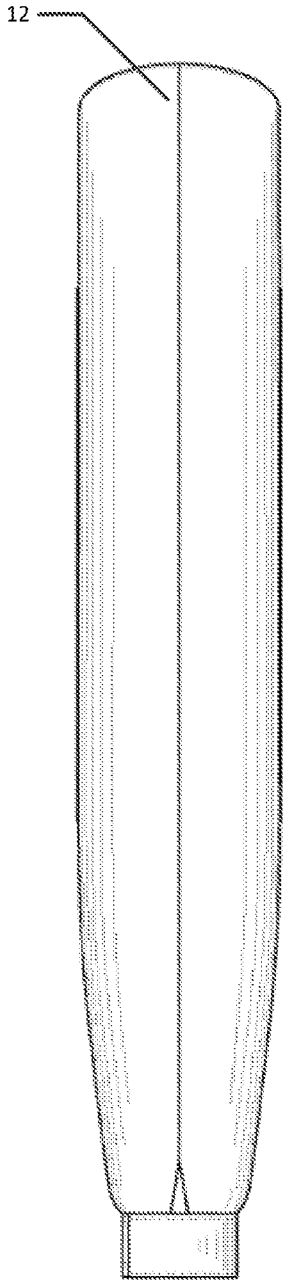
Figure 5:
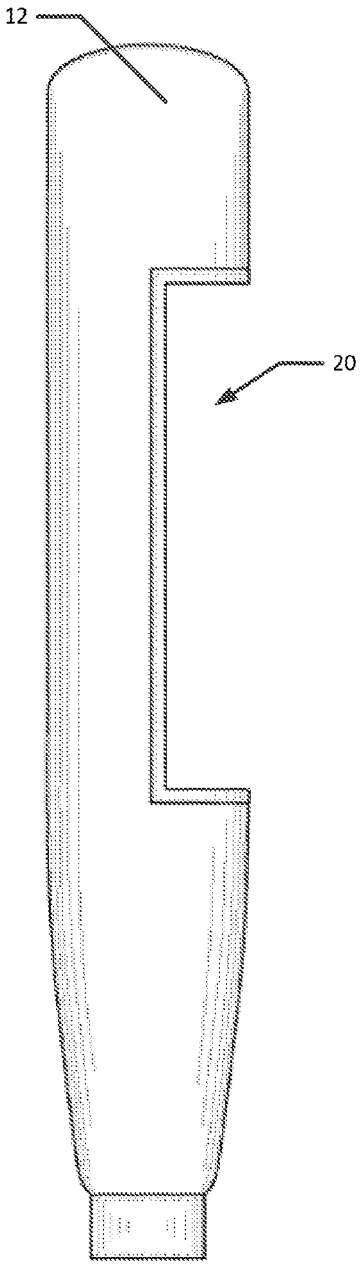
Figure 6:
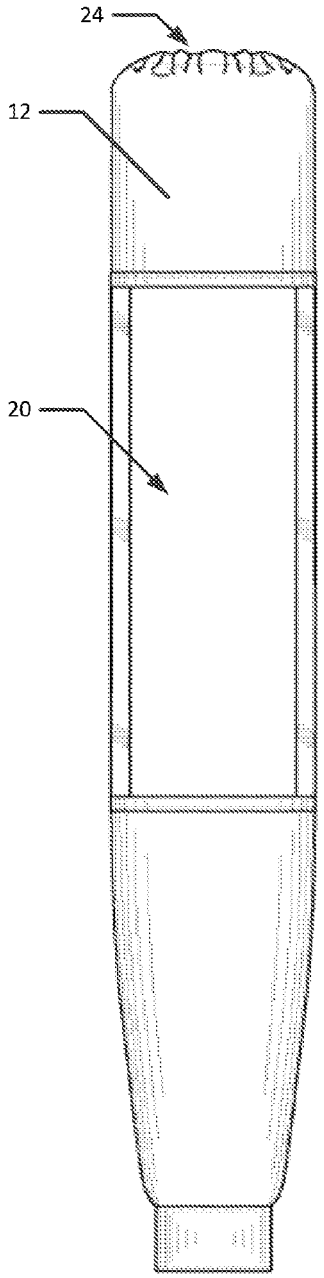
FIGS. 6-9 show front, rear, side and top views, respectively, of the batting sleeve tool according to other various embodiments of the present invention.
Figure 7:
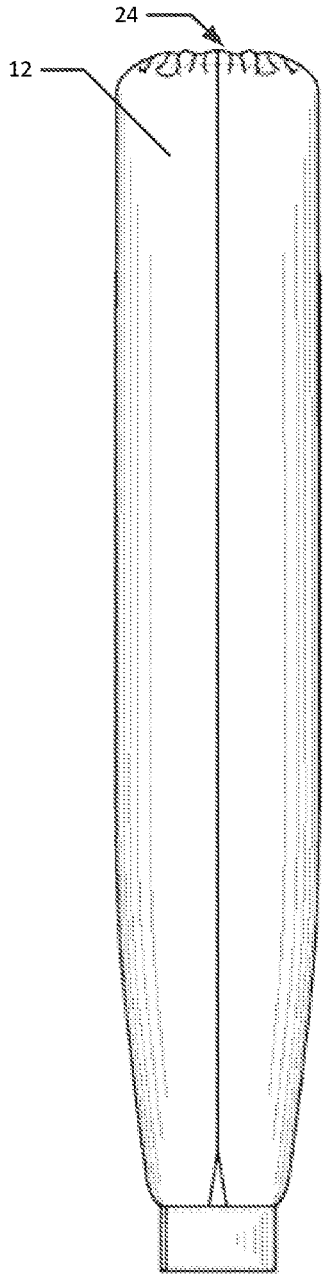
Figure 8:
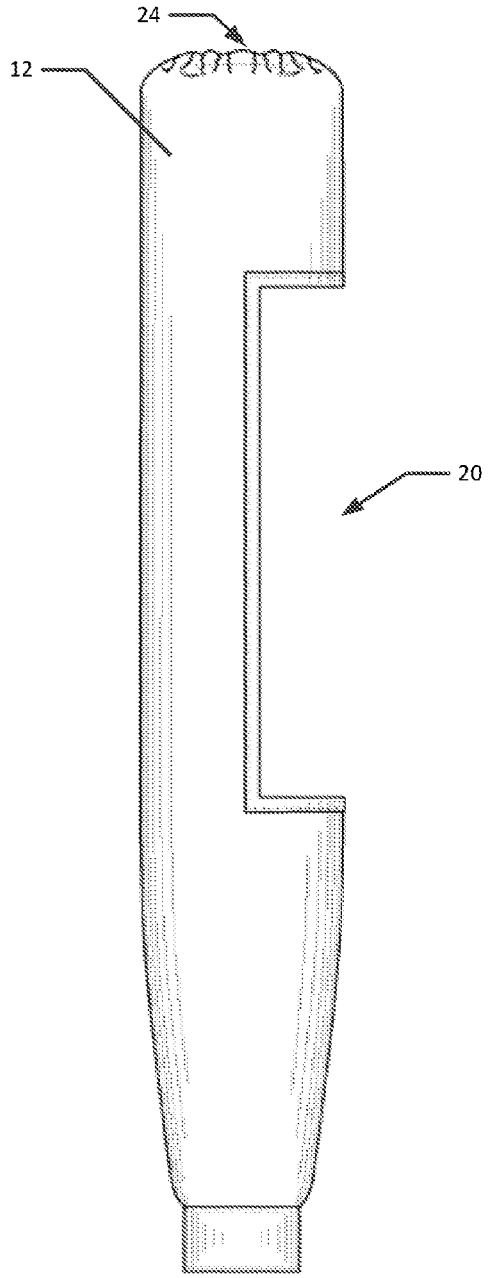
Figure 9:
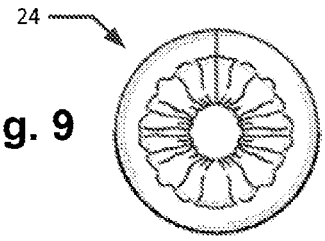

FIGS. 3-5 show front, back and side views of the sleeve 12 according other various embodiments of the present invention. As shown in FIGS. 1-5, the opening 20 may expose approximately one-half circumferentially of the barrel 16 of the bat 12. That is, the opening 20 may expose the front half of the barrel of the bat and cover the back half. That is, the opening 20 may be approximately 180 degrees. In other embodiments, the opening 20 could expose a lesser or greater portion of the barrel, although the more than 180 degrees is not desirable since the batter's aim is not to hit the ball with the back half of the bat. Plus, if the opening is more than 180 degrees, the sleeve may be more susceptible to twisting or tearing.

The tool 12 could be applied to the bat 10 in a variety of manners. As shown in the example of FIG. 2, which shows a sleeve 12 that covers the end cap 18 of the bat 10, the handle of the bat 10 can be inserted into the opening 20. The handle 14 could then be pulled down through a proximate opening 22 of the sleeve 12 until the end cap 18 can be squeezed or fitted or otherwise placed under the end portion 24 of the sleeve 12. As shown in FIG. 2, in various embodiments the proximate end of the sleeve 12 may comprises a Velcro strap 26, or some other type of fastener, to securely tighten the sleeve 12 to the bat 10.

In another embodiment, as shown in FIGS. 6-9, the sleeve 12 could have an opening (a "distal" opening) at the end portion 24 of the sleeve 12. FIGS. 6-9 show front, back, side and top views of the sleeve 12 according such embodiments. To apply the sleeve 12, the user/batter could insert the handle 14 through the opening at the end portion 24 until the barrel 16 is fully within the sleeve 12. In such embodiment, the end portion 24 of the sleeve 12 may be stretchable so that the barrel 16 of the bat 12 can fit trough the opening. The end portion opening could also have a string, drawstring or elastic band to seal or close the end portion opening, at least partially, after the bat 10 is inserted into the sleeve 12. The sleeve could also have the Velcro strap 26 (see FIG. 2) in such an embodiment.

In other embodiment, particularly where the sleeve 12 is made of a stretchable, resilient material, such as neoprene or the like, the sleeve 12 could be rolled onto the bat 10, starting at the end cap 18, until the sleeve 12 covers the barrel (except for the opening 20 that exposes the desired hitting area for the bat 10). The sleeve 12 may not include an end portion at the distal end of the sleeve 12 in such embodiments. That is, when the sleeve 12 is applied to the bat 10 in such embodiments, the sleeve 12 could have a relatively large opening at its distal end so that the end cap 18 of the bat is exposed.

In one general aspect, therefore, the present invention is directed to a hitting training device for baseball or softball. The training device comprises a sleeve-like cover that is configured to be positioned around a barrel of a bat for baseball or softball. The bat has a proximal end and a distal end, the bat having a handle closer to the proximal end and a barrel closer to the distal end. The sleeve-like cover comprises a lightweight, flexible, non-metallic, non-wood material that is a different material from a material of the barrel of the bat. The sleeve-like cover defines an opening such that, when the sleeve-like cover is positioned around the barrel of the bat, the sleeve-like cover covers a first portion of the barrel of the bat and exposes, via the opening, a second portion of the barrel of the bat. The sleeve-like cover, when positioned around the barrel of the bat, is less than a length of the bat. Also, the opening defined by the sleeve-like cover, when the sleeve-like over is positioned around the barrel of the bat, exposes less than 50% of the bat lengthwise and exposes less than 60% circumferentially of the barrel of the bat.

In various implementations, the opening, lengthwise, exposes less than 40% of the bat. Also, the material of the sleeve-like cover may comprise foam, polyurethane foam, elastomeric polymer or synthetic rubber, for example. The material of the sleeve-like cover may also comprise a resilient material and may be softer than the material of the barrel of the bat. The sleeve-like cover may weigh less than 3 ounces.

In various implementations, the sleeve-like cover defines a second, "distal" opening at an end portion of the sleeve-like cover. The sleeve-like cover may further comprise means (e.g., a drawstring, an elastic band, etc.) for closing, at least partially, the second opening when the sleeve-like cover is positioned on the bat.

The examples presented herein are intended to illustrate potential and specific implementations of the present invention. It can be appreciated that the examples are intended primarily for purposes of illustration of the invention for those skilled in the art. No particular aspect or aspects of the examples are necessarily intended to limit the scope of the present invention. Further, it is to be understood that the figures and descriptions of the present invention have been simplified to illustrate elements that are relevant for a clear understanding of the present invention, while eliminating, for purposes of clarity, other elements. While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

What is claimed is:

1. A combination for hitting training for baseball the combination comprising:

a sleeve cover that comprises a proximal end and a distal end, and wherein the sleeve cover further comprises a fastener strap at the proximal end of the sleeve cover; and a baseball bat for hitting a pitched baseball, wherein the baseball bat comprises a handle and a barrel, wherein the barrel comprises a widest portion of the baseball bat, and wherein the baseball bat comprises a proximal end and a distal end, wherein the handle is closer to the proximal end and the barrel is closer to the distal end, and wherein the baseball bat comprises a longitudinal axis;

the sleeve cover comprises a sleeve material that is lightweight, non-metallic, and non-wood, and wherein the sleeve material is a different material from a material of the barrel of the bat, and wherein the sleeve material is flexible and elastic so that the sleeve cover is fittable over the barrel of the baseball bat and remains in place during use of the baseball bat for hitting the pitched baseball ;

the sleeve cover defines a single barrel opening, with four squared-off corners and four straight edges, wherein the four straight edges comprise:

two longitudinal straight edges that are parallel to the longitudinal axis of the baseball bat; and proximal and distal transverse straight edges that are transverse to the longitudinal axis, wherein the proximal straight edge is closer to the proximal end of the sleeve cover and spaced apart from the fastener strap, and wherein the distal transverse straight edge is spaced apart from the distal end of the sleeve cover, such that, when the sleeve cover is positioned around the barrel of the bat, the sleeve cover covers a first portion of the barrel of the baseball bat and exposes, via the barrel opening, a second portion only of the barrel of the baseball bat, wherein the second portion includes the widest portion of the baseball bat, and wherein the barrel opening is sized large enough that the pitched baseball is contactable with the second portion of the barrel of the baseball bat without contacting the sleeve cover;

the sleeve cover, when positioned around the barrel of the bat, is less than a length of the baseball bat; and the barrel opening defined by the sleeve cover, when the sleeve cover is positioned around the barrel of the baseball bat, exposes less than 50% of the baseball bat lengthwise, and exposes less than 60% circumferentially of the barrel of the baseball bat.

2. The combination of claim 1, wherein the barrel opening, lengthwise, exposes less than 40% of the baseball bat.

3. The combination of claim 1, wherein the material of the sleeve cover comprises foam.

4. The combination of claim 3, wherein the foam comprises polyurethane foam.

5. The combination of claim 1, wherein the material of the sleeve cover comprises synthetic rubber.

6. The combination of claim 1, wherein the material of the sleeve cover comprises elastomeric polymer.

7. The combination of claim 1, wherein the material of the sleeve cover comprises a resilient material.

8. The combination of claim 1, wherein the material of the sleeve cover comprises a material that is softer than the material of the barrel of the baseball bat.

9. The combination of claim 1, wherein the sleeve cover weighs less than 3 ounces.

10. The combination of claim 1, wherein the sleeve cover defines a distal opening at the distal end of the sleeve cover.

11. The combination of claim 10, wherein the sleeve cover further comprises means for closing, at least partially, the distal opening when the sleeve cover is positioned on the baseball bat.

12. The combination of claim 1, wherein the fastener strap does not form one of the straight edges of the barrel opening.

13. The combination of claim 1, wherein the barrel opening is positioned between the proximal end and the distal end of the sleeve cover.

14. The combination of claim 1, wherein the sleeve material is softer than the material of the baseball bat.

15. The combination of claim 14, wherein the fastener strap does not form one of the straight edges of the barrel opening.

16. The combination of claim 14, wherein the barrel opening is positioned between the proximal end and the distal end of the sleeve cover.

17. The combination of claim 14, wherein the material of the sleeve material causes a sound of the pitched baseball contacting the sleeve cover in the first portion of the barrel of the baseball bat to have a duller sound than a sound of the pitched baseball contacting the barrel of the bat in the second portion of the barrel of the baseball bat.

* * * * *